United States Patent [19]

Falardeau

[11] 4,268,174

[45] May 19, 1981

[54] CONCRETE MIXER

[76] Inventor: Fidel Falardeau, 4851 Laurier Boulevard, La Plaine, Canada, J0N 1B0

[21] Appl. No.: 51,484

[22] Filed: Jun. 25, 1979

[51] Int. Cl.[3] ..... B28C 7/04; B01F 7/04

[52] U.S. Cl. ..... 366/18; 366/46; 366/52; 366/606

[58] Field of Search ..... 366/606, 64, 67, 45, 366/46, 47, 52, 185, 189, 40, 36, 18, 19, 17, 189

[56] References Cited

U.S. PATENT DOCUMENTS

| | | | |
|---|---|---|---|
| 2,520,033 | 8/1950 | Fuelling | 366/606 |
| 2,547,500 | 4/1951 | Selby | 366/46 |
| 2,547,787 | 4/1951 | Siebring | 366/606 |
| 2,806,680 | 9/1957 | August | 366/64 |
| 2,815,195 | 12/1957 | Bolt | 366/606 |
| 3,211,436 | 10/1965 | Butterfield . | |

FOREIGN PATENT DOCUMENTS 579280 7/1959 Canada .

*Primary Examiner*—Robert W. Jenkins

[57] ABSTRACT

A concrete mixer and the like adapted to be attached to the lifting system of a tractor or other vehicle. This mixer comprises a bucket having a cylindrical drum shape, the lateral wall of which is provided with an aperture having a maximum opening of one quarter of a circle. A shaft is mounted in the cylindrical drum along the longitudinal axis thereof and carries radial arms having mixing blades secured to their outer end. Drive means can rotate the shaft in either of the two opposite directions; that is in an unloading direction and in a mixing direction. The bucket is mounted on bearings to pivotally attach it to the lifting system and to pivot it between the unloading position in which the aperture faces downward and the loading and mixing position in which the aperture faces upward. Each mixing blade includes a bar provided along its outer edge with a flexible strip in sweeping engagement with the internal surface of the cylindrical drum and having along its inner edge a row of radial and spaced-apart fingers used to assist the mixing. The tractor is provided with a water tank at its opposite end relative to the bucket and which is used not only to supply water for the ingredients but also as a counterweight to the bucket.

6 Claims, 4 Drawing Figures

CONCRETE MIXER

The present invention relates to a concrete mixer and the like, more particularly of the type which is adapted to be attached to the lifting system of a tractor currently used to work and transport earth, sand and the like materials.

The U.S. Pat. No. 3,211,436, of Oct. 12, 1965, in the name of D. N. Butterfield defines a mixing system that is removably installed in the conventional bucket of a tractor used to work and transport earth and the like. The shape or profile of such a conventional bucket is not suited to embody therein a mixing system considering that its opening for loading and unloading has an aperture which is circumferentially too large and consequently the ingredients being mixed take too long to become mixed and accidentally unload outward. Besides, the mixing system defined in the Patent comprises radial arms made of flexible and curved blades; this is inefficient to obtain a good mixture of the various ingredients, specially when there are large lumps of either ingredient to be mixed. In the latter case, the flexible arms are certainly unable to break or disintegrate those lumps.

It is therefore the general object of the present invention to provide a concrete mixer and the like, which avoids the aforementioned disadvantages while retaining the advantages of a mixer which may be removably fixed to the lifting system of a farm tractor or the like to provide an equipment which allows, when the bucket is lowered, to easily load therein the ingredients to be mixed, to produce the mixing, and to transport the mixed ingredients by the tractor and to unload at the desired site.

A more specific object of the invention is to provide a bucket of special shape which allows rapid mixing and without loss of the ingredients. Another object of the invention is to provide mixing blades which are very efficient to break any lump of either ingredient to be mixed, to provide a uniform mixture, and to sweep and scrape the internal surface of the bucket during pouring out of the mixed ingredients.

Another object of the invention consists in providing a drive system to rotate the mixing blades in both directions in order to use those blades to expel any surplus of either ingredient and so obtain a mixture of the ingredients in the desired ratio.

Another object of the invention consists in providing a water supply which is mounted on the tractor at the opposite end respective to the mixing bucket, such as to not only serve as water supply for the ingredients to mix but also as a counterweight to the bucket.

The preceding objects and other objects of the invention will be clearer to understand by referring to the following description and drawings, in which.

In the attached drawings, the same reference numerals indicate the same elements.

Figure 1:
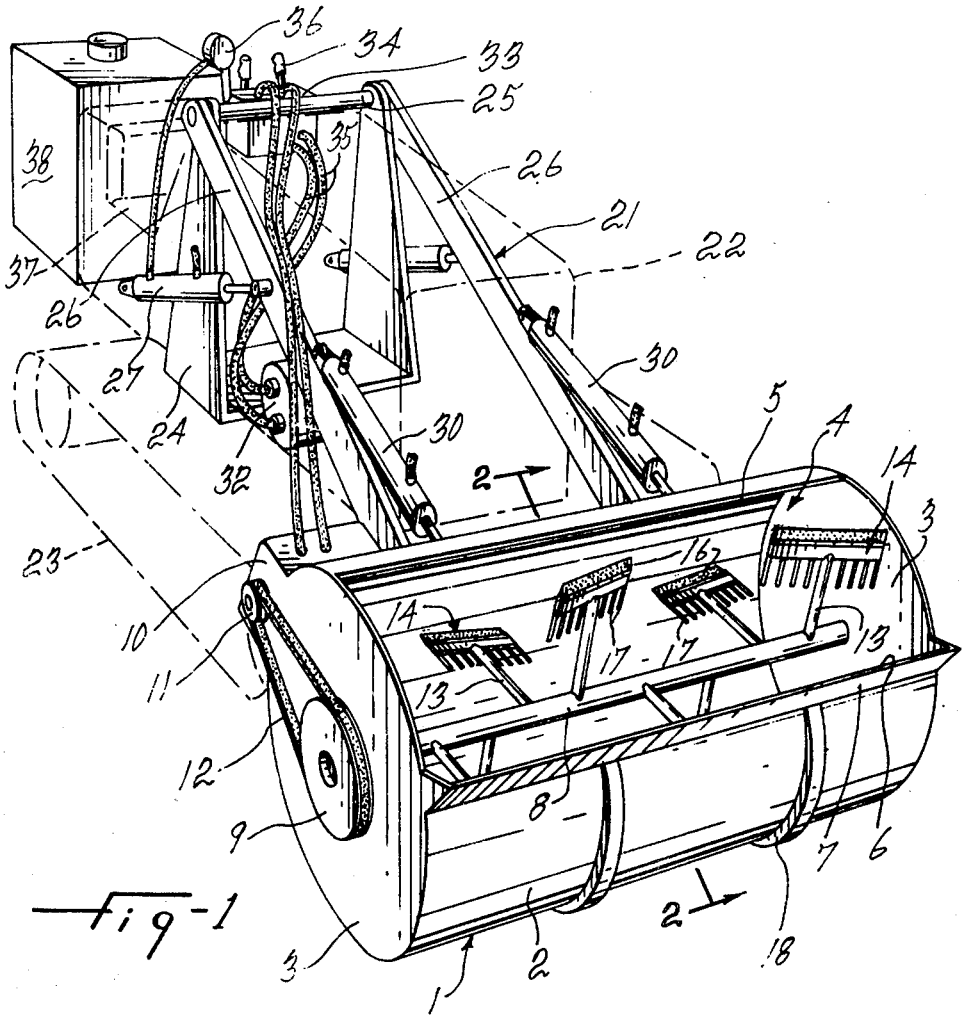
FIG. 1 is a perspective view of the system according to the present invention which is attached to a lifting system of a tractor shown in dotted lines.

The mixer according to the invention comprises a bucket 1, in the shape of a drum with cylindrical wall 2 and flat end walls 3. This drum is provided with an aperture 4, of rectangular shape, and extending from one end wall 3 to the other end wall. The longitudinal edges 5 and 6 of the aperture 4 are spaced and parallel relative to each other and to the longitudinal axis of the cylindrical drum 1. The lower edge 6 is shaped with a lip 7 throughout its length, which outwardly projects from the drum 1. The angle defined by the opening 4 with the longitudinal axis of the drum as its center has a maximum of of 90°, that is one-quarter of a circle. A shaft 8 is positioned to rotate inside the drum 1; this shaft 8 is coaxial with the longitudinal axis of the drum 1 and is carried to rotate in both end walls 3 in appropriate bearings. One end of the shaft 8 outwardly projects and is provided with a dented drive wheel 9. A reversible hydraulic drive 10 is secured to the drum 1 and its shaft is connected to the dented wheel 9 by a dented wheel 11 and a link chain 12. A plurality of rigid arms 13 are fixed to the shaft 8 in radial position and along rows at approximately 90° one with the other. A mixing blade 14 is rigidly fixed to the outer end of each radial arm 13. Each mixing blade 14 comprises a rigid bar 15 fixed in its middle to the outer end of the arm 13 and provided at its radially outer edge with a band 16, of rubber or other flexible material, adapted to engage the internal surface of the drum 1 and to sweep this internal surface. A plurality of fingers 17 are perpendicularly fixed to the radially inner edge of the bar 15; the fingers 17 are straight, rigid and parallel relative to each other and are radially directed toward the longitudinal axis of the drum 1.

The blades 14 are preferably slightly inclined relative to the shaft 8. They are inclined in opposite directions on each side of the central transversal plane of the drum 1, such that when the blades rotate in the mixing direction, as indicated by the arrows A, shown in FIG. 2, the blades 14 move the ingredients to be mixed toward this central plane of the bucket.

Strengthening bars 18 surround the cylindrical wall 2 and are fixed to it. They are equally spaced on each side of the central transverse plane of the bucket.

A first pair of bearings 19 are provided in the strengthening bars 18 while a second pair of bearings 20 are provided above the bearings 19 and at the upper rear of the strengthening bars 18. The bearings 19 and 20 are placed along separate pivot axis which are parallel to each other and parallel to the shaft 8.

The bucket 1 is therefore arranged to be connected to the conventional lifting system of a tractor, this assembly being shown by 21 and the tractor by 22. The tractor may be a farm tractor or a tractor with endless tracks 23. The lifting assembly 21 may comprise a U-shape support 24 fixed to the tractor and at the upper end of which are pivoted at 25 two levers 26, the outer ends of which are pivoted to the bearings 19 of the bracket 1. Each lever 26 is operated, to lower and lift the bucket 1, by a double action hydraulic cylinder 27 pivoted at 28 to the support 24 and at 29 to an intermediate portion of lever 26.

A second pair of double action hydraulic cylinders 30 serve to pivot the bucket 1 around the bearings 19 relative to the levers 26. Each cylinder 30 is pivoted at 31 to an intermediate portion of lever 26 and to the bucket 1 by the bearing 20.

The tractor 22 is provided in conventional manner of a hydraulic circuit comprising a reservoir and a hydraulic pump 32, as well as control valves 33 provided with actuation levers 34, and hoses 35 to feed and return the hydraulic fluid to each cylinder 27 and 30, and also to the hydraulic drive 10. Further, the hydraulic circuit comprises a manometer 36 installed in a visible position for the operator of the tractor seating on the seat 37. This manometer 36 is connected to the hydraulic cylinders 27 and, thus, serve as weighting devices to weigh the materials in the bucket 1 when the latter is in lowered position, but not resting and is being loaded of materials for the mixing thereof.

A water tank 38 is mounted on the rear of the tractor, that is at the opposite end of the tractor relative to the lifting system and to the bucket 1 to serve as counterweight to the bucket. This water reservoir has a conduit (not shown) connected in the bucket to bring the water in required quantity for mixing in appropriate proportions of sand, cement and water to mix the concrete.

Obviously, the bucket 1 could be mounted at the rear of the tractor instead of at the front of the latter. In fact, most farm tractors are provided with a lifting system at the rear, which may be used with advantage to mount on it the bucket 1 with slight changes to not only be able to lower and lift it but also to tilt or rotate it about its first pair of bearings 19. In that case, the reservoir 38 would be mounted at the front of the tractor.

Figure 2:
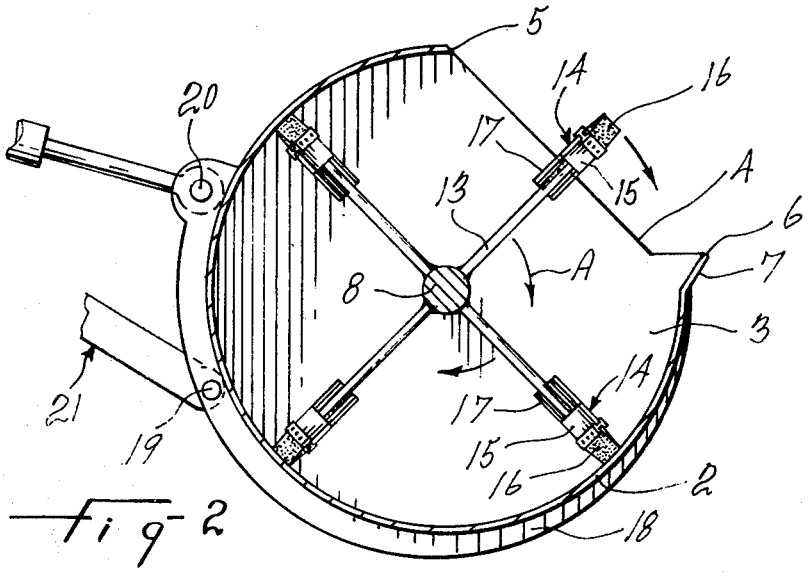
FIG. 2 is a transverse cross-section of the mixing bucket and taken along line 2—2 in FIG. 1.
Figure 4:
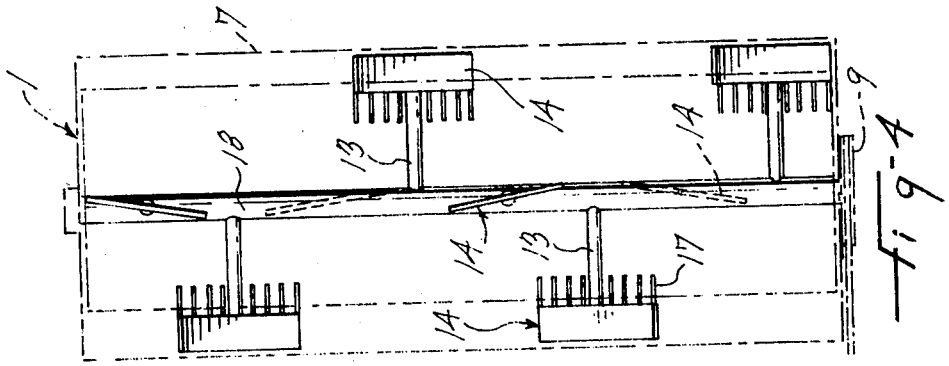
FIG. 4 is a plan view of the shaft and mixing blades in the bucket, the latter being shown in dotted lines.
Figure 3:
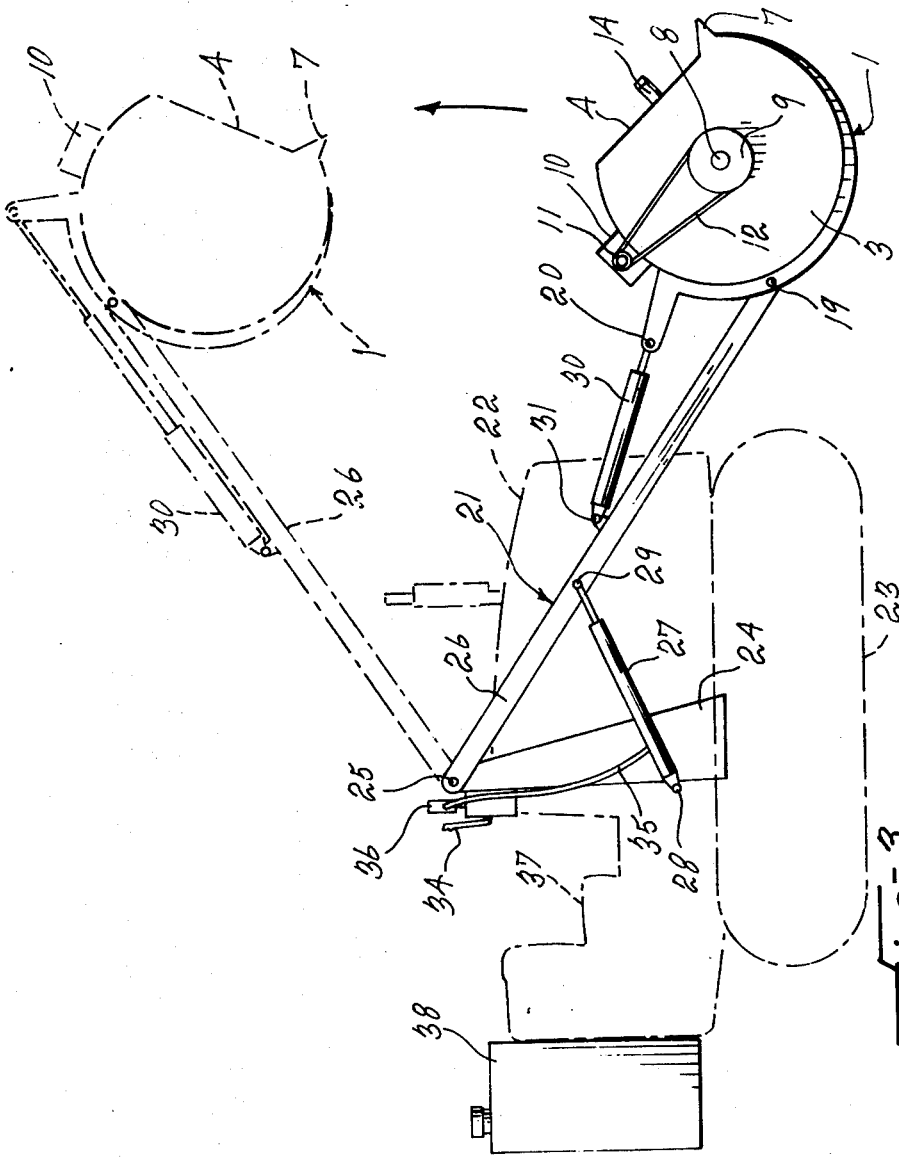
FIG. 3 is a lateral elevation view of the bucket in lowered position and of the lifting system and water tank mounted on a tractor shown in dotted lines; the FIG. 3 also shows in dotted lines the elevated and tilted position of the bucket.

In its mixing position, the bucket 1 is positioned by means of the hydraulic cylinders 30, such that its aperture 4 is facing upward, as shown in FIGS. 1, 2, and 3. In this last Figure, the mixing position is shown in full lines. When the bucket is in mixing position and is lowered to the ground, the bucket may be loaded with the appropriate ingredients for the mixing. The bucket is stopped in position slightly above the ground and the reading is taken of the manometer 36 just before, for instance, adding the sand and right after, such as to weigh the desired quantity of sand. If the desired quantity was exceeded, it is easy to rotate the shaft 8 by the hydraulic drive 10 in reverse direction compared to the direction indicated by the arrows A in FIG. 2 in order to unload the excess of sand through the aperture 4. When all the ingredients have been loaded in the bucket and in desired quantity, the hydraulic drive 10 is actuated to drive the shaft 8 in the mixing direction, that is in the direction of the arrows A in FIG. 2, and while the tractor may be moved to bring the load of concrete to the site where it is desired to unload. The unloading may be done at various heights according to the lifting assembly used; to unload, the cylinders 30 are actuated such that the bucket rotates about the bearings 19, as shown in dotted lines in FIG. 3. To complete the unloading, the shaft 8 may be driven in reverse relative to its mixing direction and, thus, the mixing blades, more particularly the flexible blades 16 which engage the internal surface of the bucket, completely sweep the latter for complete unloading of the mixed materials.

It must also be noted that the edge 6 and the lip 7 allow to directly load the bucket in the pile of sand and gravel, which allows to save substantial time.

What we claim is:

1. A concrete mixer and the like adapted to be attached to the lifting system of a tractor or the like vehicle, comprising a bucket made of a cylindrical drum having an end wall at each end of a cylindrical wall, the latter having an aperture extending from one end wall to the other end wall with longitudinal edges extending straight and substantially parallel to the longitudinal axis of the drum, the angle defined by said aperture with the longitudinal axis of the drum as center being a maximum of a quarter of a circle, a shaft mounted in the drum along the longitudinal axis of the latter and carried for rotation by the two end walls, drive means mounted on the drum and connected to the shaft to rotate the same, radial arms fixed to the shaft and spaced from each other, and mixing blades fixed to the outer end of the arms, the drum having a first pair of bearings fixed to the cylindrical wall and spaced along a pivot axis of the drum parallel to the shaft, the first pair of bearings connecting the drum to the lifting system to support the drum in a substantially horizontal position, the drum having a second pair of bearings fixed to the cylindrical wall and spaced along an axis parallel to the pivot axis of the drum to connect to drive means forming part of the lifting system and used to pivot the drum around the pivot axis thereof between a loading position with the aperture upwardly facing and an unloading position with the aperture facing downward, each mixing blade comprising a bar transversely fixed to the outer end of each of the radial arms, a flexible strip fixed to the outer edge of said bar and in sweeping engagement with the internal surface of the drum and a row of spaced-apart fingers fixed to the inner edge of said bar.

2. A tractor comprising in combination a lifting system including lifting levers pivoted at one end to the tractor, hydraulic cylinder and piston units pivoted to the tractor and levers for raising and lowering said levers, an oil pressure indicator connected to the lever raising side of one of said cylinder and piston units and measuring the oil pressure in said cylinder and piston unit, a bucket made of a cylindrical drum having an end wall at each end of a cylindrical wall, the latter having an aperture extending from one end wall to the other end wall with longitudinal edges extending straight and substantially parallel to the longitudinal axis of the drum, the angle defined by said aperture with the longitudinal axis of the drum as center being a maximum of a quarter of a circle, a shaft mounted in the drum along the longitudinal axis of the latter and carried for rotation by the two end walls, drive means mounted on the drum and connected to the shaft to rotate the same, radial arms fixed to the shaft and spaced from each other, and mixing blades fixed to the outer end of the arms, the drum having a first pair of bearings fixed to the cylindrical wall and spaced along a pivot axis of the drum parallel to the shaft, the first pair of bearings connecting the drum to the outer ends of the lifting levers to support the drum in a substantially horizontal position, the drum having a second pair of bearings fixed to the cylindrical wall and spaced along an axis parallel to the pivot axis of the drum to connect to drive means forming part of the lifting system and used to pivot the drum around the pivot axis thereof between a loading position with the aperture upwardly facing and an unloading position with the aperture facing downward, and wherein the oil pressure indicator gives an indication of the weight of the ingredients for the mixing by measuring the oil pressure increase resulting from loading of the bin.

3. A tractor as defined in claim 2, wherein the lifting system and the drum are mounted at one end of the tractor and a water reservoir is mounted at the other end of the tractor and forms a counterweight to the drum beside forming a water supply for mixing of the ingredients contained in the drum.

4. A concrete mixer and the like adapted to be attached to the lifting system of a tractor or the like vehicle, comprising a bucket made of a cylindrical drum having an end wall at each end of a cylindrical wall, the latter having an aperture extending from one end wall to the other end wall with longitudinal edges extending straight and substantially parallel to the longitudinal axis of the drum, the angle defined by said aperture with the longitudinal axis of the drum as center being a maximum of a quarter of a circle, a shaft mounted in the drum along the longitudinal axis of the latter and carried for rotation by the two end walls, drive means mounted on the drum and connected to the shaft to rotate the same, radial arms fixed to the shaft and spaced from each other, and mixing blades fixed to the outer end of the arms, the drum having a first pair of bearings fixed to the cylindrical wall and spaced along a pivot axis of the drum parallel to the shaft, the first pair of bearings connecting the drum to the lifting system to support the drum in a substantially horizontal position, the drum having a second pair of bearings fixed to the cylindrical wall and spaced along an axis parallel to the pivot axis of the drum to connect to drive means forming part of the lifting system and used to pivot the drum around the pivot axis thereof between a loading position with the aperture upwardly facing and an unloading position with the aperture facing downward, and wherein each blade comprises a bar transversely fixed to the outer end of each of the radial arms and a flexible strip fixed to the outer edge of said bar and in sweeping engagement with the internal surface of the drum, and wherein said blades are slightly inclined relative to said shaft in opposite direction relative to the central transverse plane of the drum, whereby to feed the materials being mixed towards the central plane.

5. A mixer as claimed in claim 4, in which said drive means are selectively rotatable in either of two opposite directions of rotation, whereby to drive said shaft in rotation either in direction for unloading the materials through said aperture or in a mixing direction.

6. A mixer as claimed in claim 1, 4 or 5, in combination with a tractor and a lifting system, the latter and said drum being mounted at one end of the tractor, said combination further comprising a water reservoir mounted at the other end of the tractor and forming a water supply for mixing of the ingredients contained in the drum.

* * * * *